United States Patent [19]

Yanagi et al.

[11] Patent Number: 4,738,209

[45] Date of Patent: Apr. 19, 1988

[54] WORK MATERIAL FEEDING DEVICE FOR SEWING MACHINE

[75] Inventors: Toshiaki Yanagi; Yoshikazu Kurono, both of Aichi, Japan

[73] Assignee: Brother Kogyo Kabushiki Kaisha, Nagoya, Japan

[21] Appl. No.: 947,869

[22] Filed: Dec. 30, 1986

[30] Foreign Application Priority Data

Dec. 30, 1985 [JP] Japan ..... 60-297232

[51] Int. Cl.[4] ..... D05B 19/00; H02P 8/00

[52] U.S. Cl. ..... 112/121.11; 112/309; 112/220; 318/696

[58] Field of Search ..... 112/121.11, 121.12, 112/121.15, 308, 309, 277, 220; 318/696

[56] References Cited

U.S. PATENT DOCUMENTS

| | | | |
|---|---|---|---|
| 4,133,275 | 1/1979 | Herzer et al. . | |
| 4,293,807 | 10/1981 | Foster et al. | 318/696 |
| 4,297,625 | 10/1981 | Newell | 318/696 |
| 4,300,084 | 11/1981 | Heeren | 318/696 |
| 4,582,006 | 4/1986 | Yamane | 112/121.12 |
| 4,610,210 | 9/1986 | Kinoshita et al. | 112/121.12 |
| 4,682,554 | 7/1987 | Goto et al. | 112/121.11 X |

FOREIGN PATENT DOCUMENTS

| | | |
|---|---|---|
| WO85/04061 | 9/1985 | PCT Int'l Appl. . |
| 2165107A | 4/1986 | United Kingdom . |

*Primary Examiner*—H. Hampton Hunter

*Attorney, Agent, or Firm*—Finnegan, Henderson Farabow, Garrett & Dunner

[57] ABSTRACT

A work material feeder for a sewing machine includes a work material holder which is movable within the plane perpendicular to a passageway where a needle is moved up and down, a first pulse motor which reciprocates the work material holder in one direction within the plane synchronously with the vertical movement of said needle, a second pulse motor which reciprocates the work material holder in another direction perpendicular to the aforesaid direction synchronously with the vertical movement of the needle, and a rotation divisibility switching circuit which switches the divisibility of rotation of the first and second pulse motors in several steps, the first and second pulse motors being driven in accordance with the divisibility set by the rotation divisibility switching circuit in order to move the work material holder.

4 Claims, 4 Drawing Sheets

WORK MATERIAL FEEDING DEVICE FOR SEWING MACHINE

BACKGROUND OF THE INVENTION

This invention relates to a work material feeding device or a work material feeder for a sewing machine.

A known work material feeder for a sewing machine is equipped with a pair of pulse motors as driving sources for moving a work material holder in a longitudinal direction and another (transverse) direction perpendicular thereto within the same plane perpendicular to a vertical passageway where a needle is vertically moved. A minimum unit of the movement thereof in the longitudinal or transverse direction has been set in accordance with the minimum rotation angle of the pulse motors. For example, given the rotation angle of the pulse motors, the rotation angle divided into 200 (with a minimum divisibility of 1.8 in terms of a degree), is converted into a linear movement by using gears and belts to allow the work material holder to move by 0.1 mm or 0.2 mm of a unit.

In the conventional sewing machine, however, the divisibility of the rotation angle of the pulse motors is fixed depending on the machine model; e.g., the unit cannot be changed from 0.1 mm to 0.2 mm or vice versa. In consequence, when a fine pattern, such as embroidery, is sewn with a machine having a coarse linear movement of 0.2 mm, it is difficult to sew minute patterns, whereas when ordinary sewing, such as work material sewing or bar tacking, is carried out with a machine having a fine linear movement of 0.1 mm, the slow sewing speed decreases the efficiency of the operation of the machine. If an increase in the sewing speed is attempted in the latter case, it is necessary to improve the performance of the pulse motors and their driving circuits to a considerable extent. Accordingly, there is the problem that the machine production cost is remarkably raised.

Another problem is attributed to the fact that, since ordinary and embroidery sewing pattern data are respectively prepared with 0.2 mm and 0.1 mm as a unit, both types of data cannot be utilized simultaneously by one machine since a conventional machine typically has a fixed unit of linear movement.

SUMMARY OF THE INVENTION

It is therefore an object of the present invention to provide a work feeder for a sewing machine in which the feeding divisibility is a coarse unit of measure for sewing or bar tacking work where efficiency is to be given priority and where the feeding divisibility is switched to a fine unit of measure when embroidery or similar work is to be done.

It is a further object of the invention to provide a work material feeder for a sewing machine which allows one sewing machine to be used for multiple types of sewing work such as work material sewing, bar tacking or embroidery and to be used effectively and without raising the cost of manufacture and production of the machine.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the work material feeding device for a sewing machine of this invention, comprises a work material holder means for holding a work material; a first pulse motor means for causing the relative movement between a needle and the work material holder to be in one direction within the plane intersecting the passageway of the needle; a second pulse motor means for causing the relative movement between the needle and the work material holder to be in another direction intersecting the one direction, divisibility switching means for switching the divisibility of rotation of the first and second pulse motor means in accordance with a predetermined pattern; and drive control means for driving the first and second pulse motor means synchronously with the movement of the needle in accordance with the operation of the divisibility switching means.

DETAILED DESCRIPTION OF THE INVENTION

Figure 1:
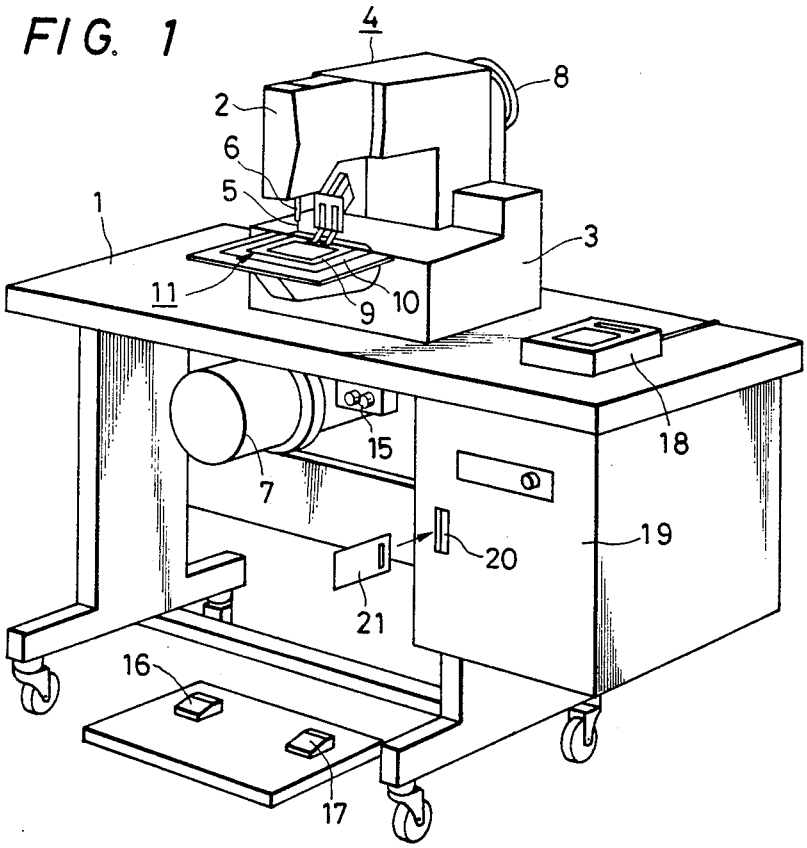
FIG. 1 is a perspective view of a sewing machine in accordance with a preferred embodiment of the present invention.

Reference will now be made in detail to the present preferred embodiment of the invention, an example of which is illustrated in the accompanying drawings in which like reference characters refer to corresponding elements.

As shown in FIG. 1, there is mounted a sewing machine body 4 on a machine table 1, the sewing machine body 4 comprising a machine arm 2 and a machine bed 3. A needle bar 6 having a needle 5 is vertically movably supported at the lower end of the machine arm 2 and vertically moved as a main machine shaft (not shown) rotates. The needle 5 and a thread ring seizing device (not shown) constitute a seam forming device and, when both of them are actuated as the main machine shaft rotates, a seam is formed in the work material.

A machine motor 7 for driving rotatably the main machine shaft is fitted to the under surface of the machine table 1 and the rotation thereof is transmitted to the main machine shaft through a known rotation transmitting mechanism including a drive pulley 8 fitted to the wedge of the main machine shaft.

Figure 2:
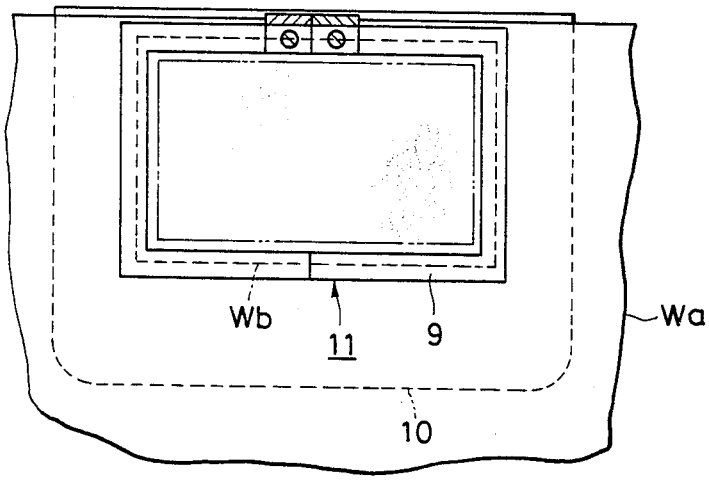
FIG. 2 is a partially enlarged top view showing a work material holder in accordance with a preferred embodiment of the present invention.

As shown in FIGS. 1 and 2, a work material holder 11 including a holding frame 9 and a pallet 10 is movably arranged on the plane where the work material is supported in front of the machine bed 3, i.e., within the horizontal plane perpendicular to the vertical passageway of the needle 5.

Figure 3:
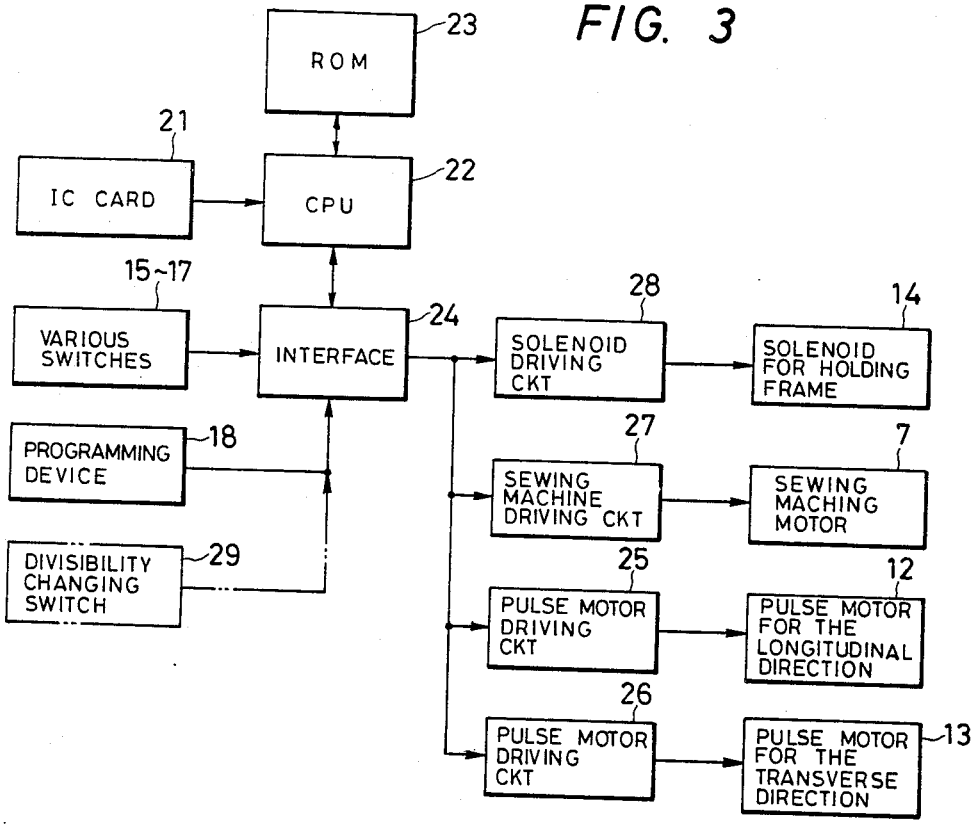
FIG. 3 is a block diagram showing the electrical construction of the sewing machine of FIG. 1.

A first pulse motor 12 and a second pulse motor 13 are coupled to the work material holder 11 to be actuated as shown in FIG. 3. While the work material is held between the holding frame 9 and the pallet 10, the work material holder 11 is longitudinally reciprocated by the first pulse motor 12 within the horizontal plane, and reciprocated by the second pulse motor 13 in the transverse direction perpendicular to the longitudinal direction. Moreover, the holding frame 9 is vertically moved in accordance with the actuation of a holding-frame actuated solenoid 14 shown in FIG. 3 and, while the holding frame 9 is kept in the elevated position, the work material composed of, e.g., texture Wa and a piece of cloth Wb as shown in FIG. 2 is so arranged as to be held between the holding frame 9 and the pallet 10.

As shown in FIG. 1, an ON/OFF switch 15 for supplying power to the machine is arranged on the lower portion of the front of the machine table 1 and a foot starting switch 17 for starting the machine as well as a foot switch 16 for actuating the holding-frame actuating solenoid 14 are arranged under the machine table 1. There is also arranged a programming device 18 on the upper right-hand surface of the machine table which is used for preparing sewing data, such as data needed to actuate the pulse motor 12 or 13, for a desired pattern to be sewn and driving data for the machine motor.

Furthermore, a control box 19 is installed in the lower right-hand portion of the machine table 1 and an integrated circuit (IC) card fitting slot 20 is bored in the front panel thereof. A thin platelike IC card 21 is insertable therein, the IC card is used to store the sewing data to be read or written. The IC card 21 is prepared by incorporating an IC in a plastic card such as, for example, the IC card MELCARD, a trademark of and manufactured by Mitsubishi Denki Kabushiki Kaisha.

As shown in FIG. 3, and in accordance with a preferred embodiment of the present invention, a central processing unit (CPU) 22 used as a control means is contained in the control box 19 and a Read Only Memory (ROM) 23 is connected thereto. A program for controlling the actuation of the entire sewing machine is stored in the ROM. A paper recorded with the sewing pattern is held at the work material holder 11. In order to move the work material holder 11 in such a manner that the sewing pattern moves relative to the position where the needle falls, the desired keys of the programming device 18 are depressed to supply a desired signal to the CPU 22 from the programming device 18 through an interface 24 while the IC card 21 is fitted in the IC card slot 20. The CPU 22, in response to the input signal, operates so as to actuate each of the pulse motors 12 and 13 through each of the pulse motor driving circuits 25, 26 and moves the work material holder 11. CPU 22 also controls the vertical movement of the needle 5 by driving the machine motor 7 through use of a machine motor driving circuit 27.

Figure 4:
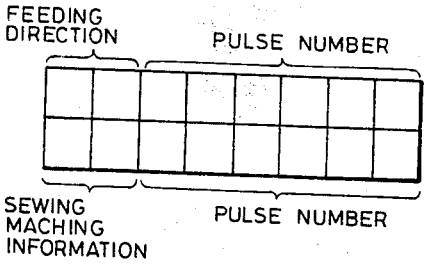
FIG. 4 is an illustration of a format for sewing data for a stitch in accordance with a preferred embodiment of the present invention.

Based on the programming operation, the CPU 22 writes the sewing data, comprising data for actuating each of the pulse motors 12, 13, and the control data for machine motor 7, into the IC card 21 for every stitch. As shown in FIG. 4, the data for one stitch is formed of two bytes, with two bits allotted to data representing the machine motor control data (machine information such as suspension, operation at low or high speed, and pattern end) and 14 bits alloted to actuating data for the pulse motors 12, 13. Of the 14-bit actuating data, 2bits store data representing the direction of rotation of each pulse motor 12, 13, i.e., data on the direction in which the work material holder is fed, whereas 12 bits represent data consisting of the driving pulse number of each pulse motor 12, 13.

Figure 5:
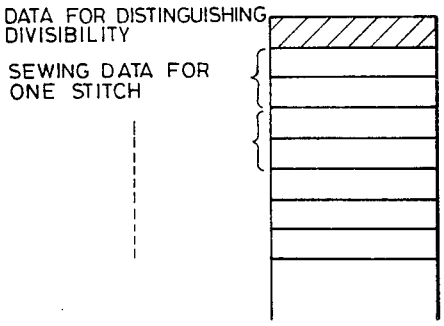
FIG. 5 is an illustration of a format of the whole sewing data for an entire item to be sewn in accordance with a preferred embodiment of the present invention.

A data array in a format as shown in FIG. 5 is stored in the IC card 21 and, in its initial portion, there are stored data equivalent to one byte for determining whether the rotation divisibility of the pulse motors 12, 13 on both sides is 0.1 mm or 0.2 mm calculated in terms of the unit of the movement of the work material holder 11 and subsequently the sewing data of two bytes for every stitch are stored. The CPU 22 utilizes the data for determining the divisibility stored in the IC card 21 at the time of a sewing operation and, by supplying the switching signal to the pulse motor driving circuits 25, 26, switches the operation to the first and second pulse motors 12, 13 in accordance with the data.

Figure 6:
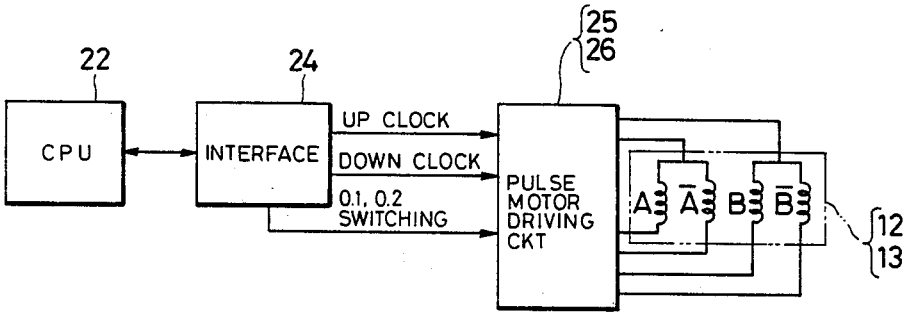
FIGS. 6 and 7 are block diagrams showing unipolar and bipolar exciting drive methods for pulse motors for the sewing machine of FIG. 1, respectively.
Figure 7:
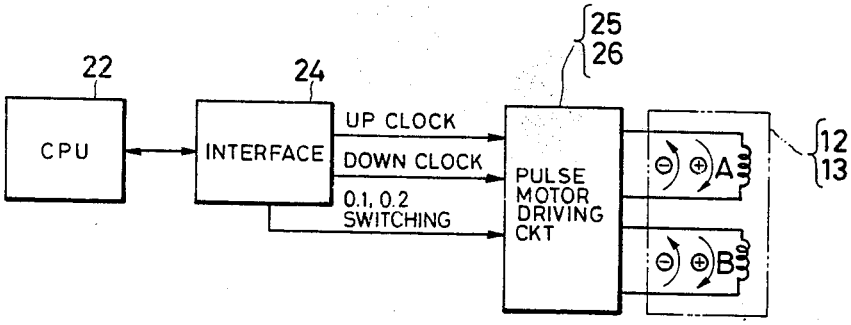

In other words, a four-phase pulse motor is used as each of the pulse motors 12, 13 according to this embodiment and driven under the known unipolar exciting driving method shown in FIG. 6 or the known bipolar exciting driving method shown in FIG. 7. Under the unipolar method of FIG. 6, the exciting sequence is switched over to two-phase excitation of $AB \rightarrow A\overline{B} \rightarrow \overline{AB} \rightarrow \overline{A}b \rightarrow AB$ . . . when the divisibility of 0.2 mm is determined, whereas it is switched over to one-two-phase excitation of $AB \rightarrow A \rightarrow A\overline{B} \rightarrow \overline{B} \rightarrow \overline{AB} \rightarrow \overline{A} \rightarrow \overline{A}B \rightarrow B \rightarrow AB$ when the divisibility of 0.1 mm is determined. Under the bipolar method of FIG. 7, the exciting sequence is switched over to two-phase excitation of $A+B+ \rightarrow A+B- \rightarrow A-B+ \rightarrow A+B+$ . . . when the divisibility of 0.2 mm is determined, whereas it is switched over to one-two-phase excitation of $A+B+ \rightarrow A+ \rightarrow A+B- \rightarrow B- \rightarrow A-B- \rightarrow A-B+ \rightarrow B+ \rightarrow A+B+$ . . . when the divisibility of 0.1 mm is determined. In this embodiment, the IC card 21 and the CPU 22 constitute the rotation divisibility switching means. When the operation is switched over to 0.2 mm, coarse feeding of 0.2 mm unit is given to the work material holder 11 based on the sewing data, and fine feeding of 0.1 mm unit is given to the work material holder 11 when the operation is switched over to 0.1 mm.

Figure 8:
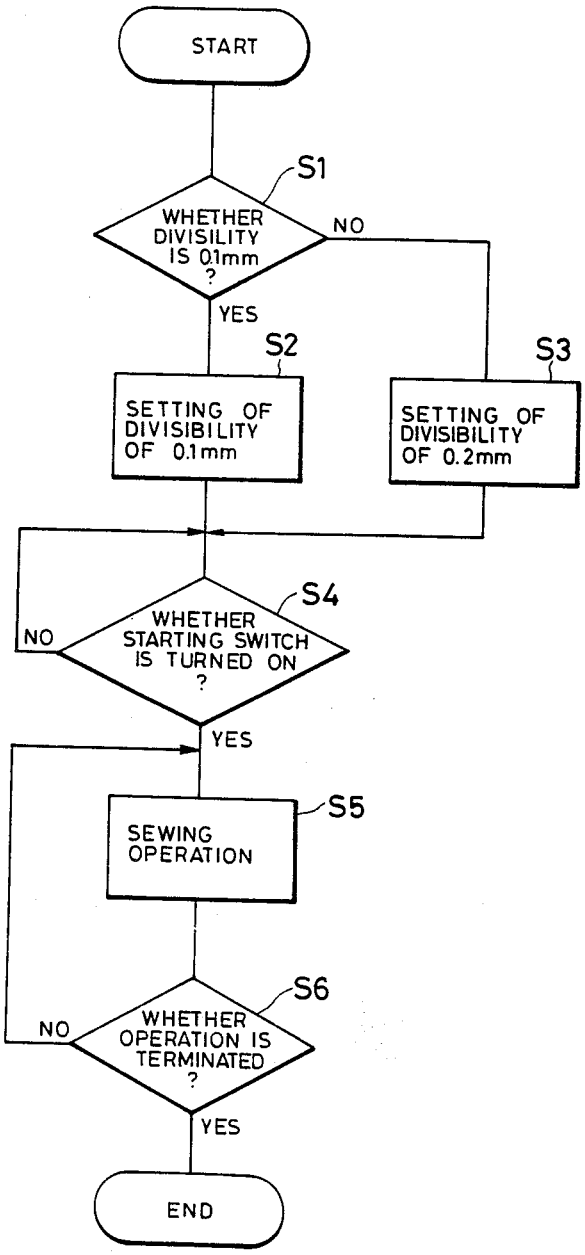
FIG. 8 is a flowchart illustrating the operation of the work material feeder in accordance with a preferred embodiment of the present invention.

The operation of the sewing machine when used with the present invention is shown in FIG. 8. When sewing based on the sewing data prepared according to the aforesaid programming operation is carried out, the ON/OFF switch 15 is first operated to supply power to the sewing machine. Then, the IC card 21 is fitted in the IC card slot 20 to electrically connect the IC card 21 to the CPU 22. The CPU 22 initializes the data address in the IC card 21 in step S1 and reads the data for determining the divisibility from the IC card 21 and determines whether the divisibility is 0.1 mm. When the result thus determined is YES, the CPU 22 supplies a low level switching signal to the pulse motor driving circuits 25, 26 and sets both the pulse motors 12, 13 at the divisibility of 0.1 mm in Step S2, whereas when the answer at step S1 is NO, CPU 22 supplies a high level switching signal to the pulse motor driving circuits 25, 26 and sets both the pulse motors 12, 13 at the divisibility of 0.2 mm in Step S3.

Then the actuating switch 16 is operated to cause the CPU 22 to actuate the solenoid 14 through the interface 24 and the solenoid driving circuit 28, whereby the holding frame 9 of the work material holder 11 is lifted. The texture Wa and the piece of cloth Wb shown in FIG. 2 are set between the holding frame 9 and the pallet 10 in that state and, by operating the starting switch 17 in Step 54, the starting signal is inputted into the CPU 22. In response to the signal, the CPU 22 reads the sewing data for every stitch from the IC card 21 in Step S5 and, based on the data, supplies the driving signal to the pulse motors 12, 13 through the pulse motor driving circuits 25, 26 and to the machine motor 7 through the machine motor driving circuit 27 so as to execute the sewing operation. Scanning is continued through Steps S5 and S6 until the CPU 22 reads termination data out of the sewing data in Step S6 thereby ending the sewing operation.

The pulse motors 12 and 13 are driven in the coarse divisibility state of 0.2 mm based on the sewing data stored in the IC card 21 when sewing as shown in FIG. 2, in which the piece of cloth Wb is sewn on the texture Wa, is carried out. The work material holder 11 for holding the texture Wa and the piece of the cloth Wb is also supplied with coarse feeding of 0.2 mm unit so that it is possible to carry out the sewing work efficiently for a short time. When a fine pattern such as embroidery is to be sewn in the work material, both the pulse motors 12, 13 are driven in the fine divisibility state of 0.1 mm based on the sewing data stored in the IC card 21 and the work material holder 11 for holding the work material is provided with fine feeding of 0.1 mm unit, so that it is possible to carry out the sewing work efficiently for forming a finely finished pattern.

The present invention is not limited to the above-described embodiment. For example, instead of the switching of divisibility based on the sewing data stored in the IC card 21 according to the aforesaid embodiment, it is possible to switch the divisibility of the pulse motors 12 and 13 by switching a divisibility changing switch 29 separately provided as shown by the dashed line in FIG. 3. Also, although the work material holder 11 moves in the horizontal plane in the aforesaid embodiment, it is possible to construct the feeder such that the needle 5 moves in the horizontal plane.

As set forth above, the feeding divisibility is a coarse unit during ordinary sewing and bar tacking work where priority is given to speed and efficiency and it is switched to be a fine unit when the sewing machine is to be used for sewing such as embroidery in which priority is given to fine sewing, so that one sewing machine may be utilized for various types of sewing effectively without raising the cost of production.

It will be apparent to those skilled in the art that various modifications and variations can be made to the apparatus of the present invention without departing from the scope or spirit of the invention. Thus, it is intended that the present invention cover the modifications and variations of this invention provided they come within the scope of the appended claims and their equivalents.

What is claimed is:

1. A work material feeding device for a sewing machine, comprising:
   - work material holder means for holding a work material;
   - first pulse motor means for causing the relative movement between a needle and said work material holder to be in one direction within the plane intersecting the passageway of said needle;
   - second pulse motor means for causing the relative movement between said needle and said work material holder to be in another direction intersecting said one direction;
   - divisibility switching means for switching the divisibility of rotation of said first and second pulse motor means in accordance with a predetermined pattern; and
   - drive control means for driving said first and second pulse motor means synchronously with the movement of said needle in accordance with the operation of said divisibility switching means.

2. A work material feeding device for a sewing machine as claimed in claim 1, wherein said divisibility switching means includes memory means for storing a divisibility data for operating said first and second pulse motor means.

3. A work material feeding device for a sewing machine as claimed in claim 1, wherein said divisibility switching means includes a divisibility changing switch.

4. A work material feeding device for a sewing machine, comprising:
   - a work material holder means for holding a work material, said work material holder being movable within the plane intersecting a passageway where a needle is moved up and down;
   - a first pulse motor means for moving said work material holder in one direction within the plane synchronously with the movement of said needle;
   - a second pulse motor means for moving said work material holder means in another direction within said plane intersecting the one direction synchronously with the movement of said needle;
   - rotation divisibility switching means for switching the divisibility of rotation of said first and second pulse motor means in accordance with a predetermined pattern; and
   - driving means for driving said first and second pulse motors in accordance with the operation of said rotation divisibility switching means.

* * * * *